US005110349A

United States Patent [19]

Westergren et al.

[11] Patent Number: 5,110,349

[45] Date of Patent: May 5, 1992

[54] CUTTING INSERT OF SINTERED HARD ALLOY

[75] Inventors: Kenneth Westergren, Hägersten; Gerold Weinl, Alvsjö; Rolf Oskarsson, Rönninge, all of Sweden

[73] Assignee: Sandvik AB, Sandviken, Sweden

[21] Appl. No.: 612,852

[22] Filed: Nov. 14, 1990

[30] Foreign Application Priority Data

Nov. 15, 1989 [SE] Sweden ..... 8903835

[51] Int. Cl.[5] ..... C22C 29/12; C22C 29/16; B22F 3/12

[52] U.S. Cl. ..... 75/233; 75/232; 75/234; 75/235; 75/236; 75/237; 75/238; 75/239; 75/240; 75/241; 75/242; 75/244; 419/13; 419/14; 419/15; 419/16; 419/17; 419/18; 419/19; 419/32; 419/38; 419/39

[58] Field of Search ..... 428/547, 610; 419/38, 419/13, 14, 19; 75/232, 234, 236, 238, 237, 239, 240, 242

[56] References Cited

U.S. PATENT DOCUMENTS 4,935,057 6/1990 Yoshimura et al. ..... 419/38 X
4,956,012 9/1990 Jacobs et al. ..... 419/38 X

*Primary Examiner*—Brooks H. Hunt
*Assistant Examiner*—Daniel J. Jenkins
*Attorney, Agent, or Firm*—Burns, Doane, Swecker & Mathis

[57] ABSTRACT

A cutting insert of a sintered carbonitride alloy and with a complicated geometry, the insert having improved efficiency. This is obtained by giving the powder non-uniform compaction during pressing of the powder into a press-body so that the ultimate working edges will have a higher relative density than the surrounding, more "supporting" material in the press-body. By these means are often obtained surface defects in the form of cracks because of dissolved strains during the sintering.

12 Claims, 3 Drawing Sheets

CUTTING INSERT OF SINTERED HARD ALLOY

BACKGROUND

The present invention relates to titanium-based carbonitride alloys particularly useful in tools for chip-forming machining such as turning and milling.

It is generally known in the cemented carbide industry that surface defects such as cracks, pores, etc., near to a working cutting edge can have a negative influence on the efficiency of cutting tools. Cemented carbide usually means sintered hard alloys based upon tungsten carbide (WC), cobalt (Co) and cubic carbides such as TiC, TaC and NbC.

A group of materials being used today mainly for inserts for finishing operations are titanium-based carbonitride alloys colloquially often named cermets. The hard phase of these alloys consists essentially of cubic phases of so-called Bl-type of TiC-TiN being wholly or partly alloyed with other carbide- or nitride-forming elements such as W, Mo, Ta, Nb, V, Hf, Cr and Zr. The hard constituents are usually present as more or less rounded particles with core-rim structure but can also be present as needle- or disk-shaped monocrystals. By suitable choice of raw materials and/or manufacturing method the core-rim structure can be modified so that desired properties are obtained. The binder phase consists of one or more of the metals Fe, Co and Ni of the iron group, usually Ni or Ni+Co. Often the binder phase is alloyed with one or more of the carbide- or nitride-forming elements. Other hard phases other than the cubic nitrides and carbides can occur, e.g., WC. The mentioned alloys are in their nature considerably more brittle than the classic cemented carbide essentially due to the fact that the wetting between titanium hard constituents and the binder phase—consisting of either merely nickel or of nickel and cobalt—is not as good as that between tungsten carbide and cobalt.

Furthermore, it can be observed that these carbonitride alloys are seen relatively as more fine-grained than "normal" cemented carbide. This essentially depends upon the fact that the actual powder is more difficultly ground than that of cemented carbide, is coming from more fine-grained raw materials and/or has less disposition towards grain growth. Fine-grained powder is more difficult to press to pressbodies than less difficult ground powder because of, i.e., spring-back.

Titanium-based carbonitride alloys also often contain, intentionally or unintentionally, a surface zone with another composition than the rest of the material being up to some 100 μm in width.

Hard constituents such as carbides, nitrides ad/or carbonitrides of titanium have a much greater thermal expansion coefficient than tungsten carbide. As the amounts of the hard constituents as well as those of the binder phase are about the same, the titanium carbonitride alloys have a considerably greater thermal expansion coefficient than ordinary cemented carbide. This causes a titanium carbide pressed body to expand more relatively than a cemented carbide pressed body during heating to sintering temperature.

From the above, and from other additional factors, it is realized that it is considerably more difficult to make dense bodies of carbonitride alloys being free of defects than of cemented carbide, i.e., because cracks or other weaknesses from the pressing have much greater tendencies to open during the run up to the sintering temperature. This is particularly applicable to complicated geometrical forms having sudden "steps" with relative thickness differences. As carbonitride alloys furthermore are brittle by their nature, a disastrous influence on the toughness behavior can be expected for sintered cutting inserts of carbonitride alloys if they have defects of the above mentioned kind near to a working edge.

SUMMARY OF THE INVENTION

The invention provides a sintered cutting insert of a material comprising at least 50% by volume of at least one hard phase selected from carbides, nitrides, oxides and mixtures thereof of at least one metal selected from group IVb, Vb or VIb elements of the periodic table, and a binder phase comprising at least one element selected from Co, Ni and Fe. The press-body of this material has been given non-uniform compaction so that the working edges after the pressing, but not after sintering, have a higher relative density than surrounding material. The material can be a titanium based carbonitride and surface defects can be provided on the rake face in the form of cracks having a width of 2 to 10 μm and a depth of up to 50 μm.

The invention also provides a method of making a cutting insert from a powder of the above material by non-uniformly compacting a mixture of the material such that the press-body has a higher relative density int he working cutting edge than in the material surrounding the cutting edge and sintering the pressbody to form a sintered cutting insert having surface defects in the form of cracks in the working cutting edge which have an inner surface consisting essentially of binder phase, the cutting insert having the same relative density throughout.

DETAILED DESCRIPTION OF THE PREFERRED EMBODIMENTS

The present invention overcomes problems with respect to conventional cutting inserts.

Figure 1:
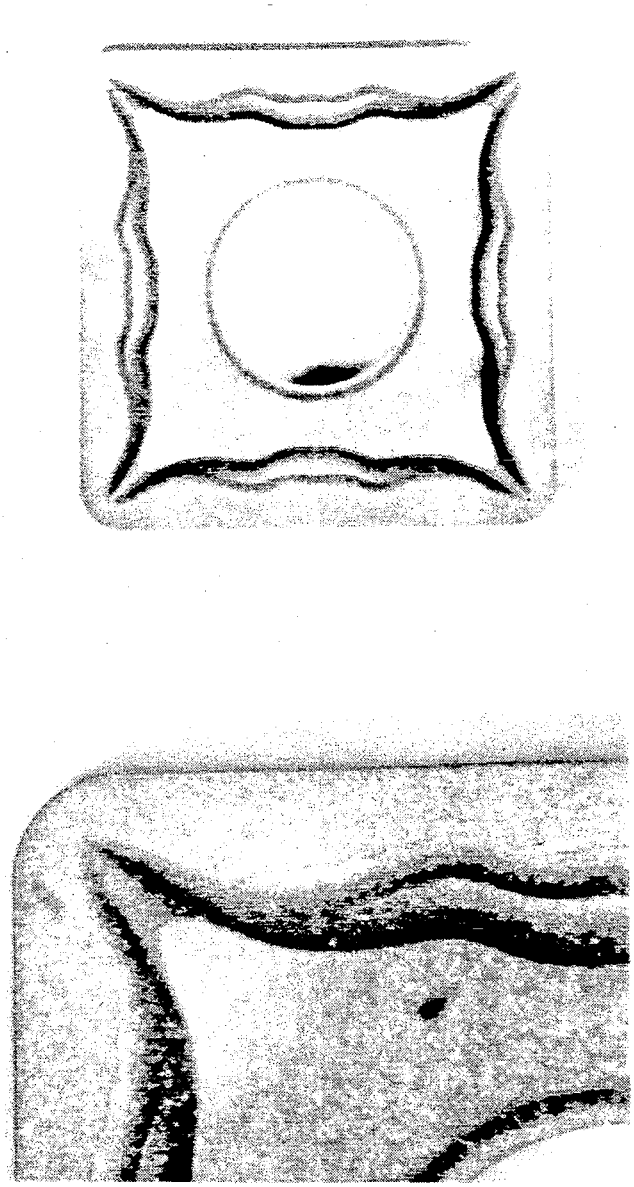
FIG. 1 shows a defect containing cutting insert in accordance with the invention at a magnification of 5×; and a portion of the cutting insert at a magnification of 1533.
Figure 2:
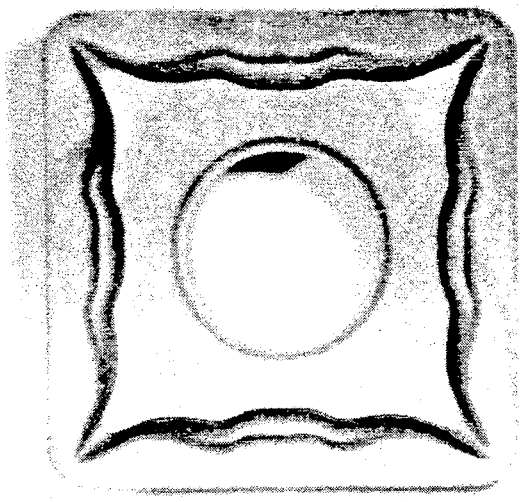
FIG. 2 shows a cutting insert without defect at a magnification of 5×.
Figure 3:
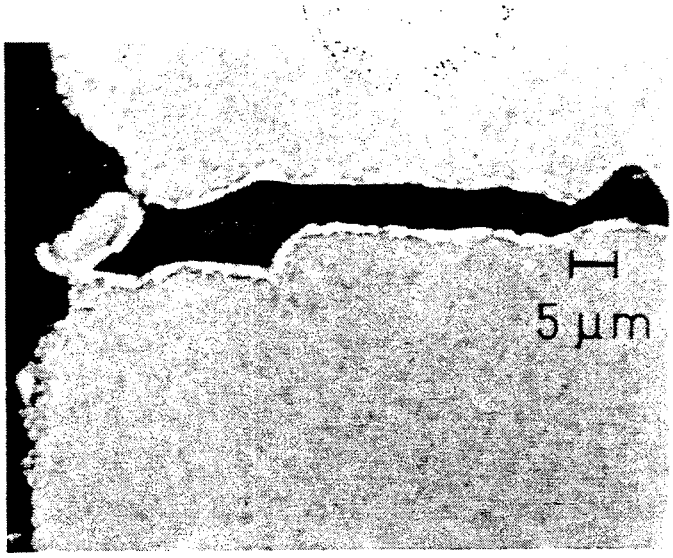
FIG. 3 shows healing of defects in a portion of a cutting insert in accordance with the invention at a magnification of 1000×.

In particular, it has now surprisingly been found that cutting inserts of titanium-based carbonitrides which have been given defects usually in the form of cracks as explained earlier by non-uniform powder filling and/or pressing, see FIG. 1, have considerably better efficiency than corresponding cutting inserts without defects, see FIG. 2. This result is contrary to what can be expected. It has been found from metallographic examinations of a sample cut perpendicularly to the cracks that these have partly "healed" during the sintering, see FIGS. 3 and 4, i.e., been rounded and now have an "inner surface" consisting essentially of binder phase. "Sharp", not partly healed cracks are naturally considerably more dangerous for the toughness behavior.

In testing such material the earlier described effects were obtained, i.e., better edge toughness behavior in materials with defects in the form of surface reliefs and cracks than in "perfect" materials. The material according to the invention is thus better because strains have dissolved and the working edge (due to the higher degree of compaction during pressing) has better properties in the sintered condition in the form of maintained sharpness and less tendency to chippings. In the case of titanium carbonitride alloys, a degenerated edge often leads to rapid and major failures.

Because the cracks have at least partly been healed, their negative influence has been greatly decreased and reduced to surface defects of a more cosmetic nature rather than a strongly embrittling effect. Thus, it can only partly be explained why the cracks do not have any considerable weakening influence or why those edges function better than those without defects of the described kind.

Figure 4:
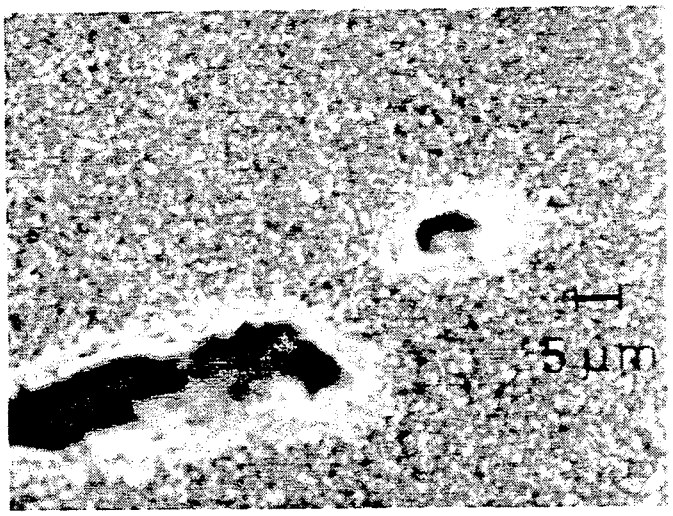
FIG. 4 shows healing of defects in a portion of a cutting insert in accordance with the invention at a magnification of 1000×.

It has been found that cutting inserts showing cracks and surface reliefs according to the earlier description have non-uniformly compacted edges from the pressing. According to established knowledge in the cemented carbide field, a uniform powder filling and an even compaction to the same relative density in all the compressed body have been aimed at—as far as possible—in order to obtain edges free of defects and without weaknesses reducing the toughness. Contrary to this established aim, it has now been found that non-uniformly compacted edges show a better behavior. The non-uniformity shall naturally not be arbitrary. A higher degree of compaction has to be created in the working cutting edge itself. These non-uniformities gradually lead to stresses in the material as it begins to expand non-uniformly when the temperature is increased and the strains are dissolved often giving rise to cracks during the run to the sintering temperature. The sintering temperature is in the range 1350°-1500° C. for the titanium-based carbonitride alloys involved in the present invention. Said "run-up" cracks are smoothed and rounded, i.e., partly healed, during the sintering period when liquid material is present. This can later be established by means of ground samples such as discussed above with respect to FIGS. 3 and 4.

According to the invention there is thus now available a cutting insert, preferably for chipforming machining, which in the pressing has been given an non-uniform compaction so that the working edges have had a higher density after the pressing but not after the sintering than that of surrounding material. As a consequence, the cutting inserts have usually obtained cracks and surface reliefs. The cutting inserts are of a material consisting of at least 50% by volume of hard, preferably cubic, phases of one or more carbides, nitrides oxides or mixtures thereof of metals from group IVb, Vb or VIb of the periodic table; or mixtures 5 thereof and a binder phase consisting of Co, Ni and/or Fe. The mentioned cracks are about 2-10 μm, preferably about 5 μm wide and up to 500 μm, preferably 50-400 μm deep. They are distributed as a band of smaller cracks >1 mm long or as a longer interconnecting crack. The cracks occur on the rake face, particularly on the chipbreaker, close to the working edge but can also go around the whole cutting insert. Cracks can also be present on the clearance face. They are often symmetrical with respect to the cutting insert. The crack wall is covered by a 1-5 μm thick layer of binder phase and the structure next to the crack is enriched in binder phase.

Figure 5:
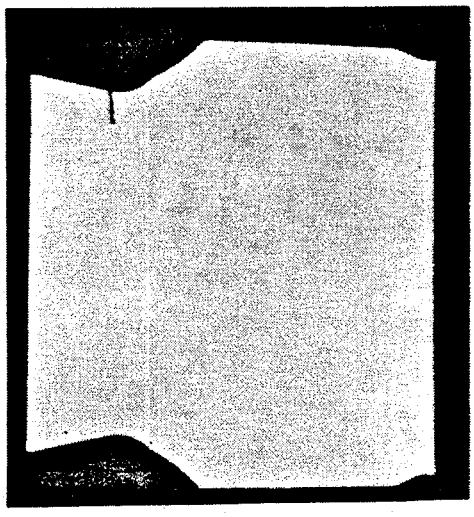
FIG. 5 shows a complicated cutting insert with sintered-in chip breakers in accordance with the invention at a magnification of 10×.

The invention is particularly applicable to complicated cutting inserts with sintered-in chip-breakers. Examples of an intersection of such a geometry is shown in FIG. 5. When chipbreakers are used the cracks are preferably situated at the bottom of the chipbreaker groove.

Cutting inserts according to the invention can naturally be coated with one or more hard layers of TiC, TiN, TiCN, $Al_2O_3$, etc., by known techniques.

The invention also relates to a method of making cutting inserts by powder metallurgical means, by pressing and sintering of a material containing at least 50% by volume of hard, preferably cubic, phases of one or more carbides, nitrides, oxides or mixtures thereof of metals from group IVb, Vb or VIb of the periodic table or mixtures thereof and a binder phase consisting of Co, Ni and/or Fe, during which pressing the powder is given an non-uniform compaction so that the pressed body has a higher relative density in those areas which are to form the working edges in the finally sintered cutting insert than in the surrounding material.

The invention is additionally illustrated in connection with the following Example which is to be considered as illustrative of the present invention. It should be understood, however, that the invention is not limited to the specific details of the Example.

EXAMPLE 1

A sintered carbonitride alloy with the following composition (in % by weight): Co 10.8, Ni 5.4, WC 15.9, TiC 28,8, TiN 19.6, TaC 6.3, VC 3.9, $Mo_2C$ 9.3 has been used to make cutting inserts according to the invention. (The composition is for the sake of simplicity given as elementary raw materials even if duplex ones are used, e.g., (Ti,Ta)C, Ti(C,N) and/or (Ti,Ta)(C,N)). Raw materials having a grain size of 1-10 μm were milled for 50 hours in a conventional cemented carbide mill (ball mill) with hard-metal cylpebs as milling bodies. In connection with the milling, 4% by weight of pressing medium (polyethylenglycol) was added. After drying of the powder in usual ways, spray-drying in inert atmosphere, cutting inserts type SNMG 120412-MF were pressed with a pressure usually exceeding 150 MPa. During the pressing the so-called counter-holding was reduced so that a non-uniform compaction the above description existed. The result was that surface defects were later obtained in the sintered material in the form of cracks situated close to the working part of the edge. The cutting inserts were blasted after sintering.

Figure 6:
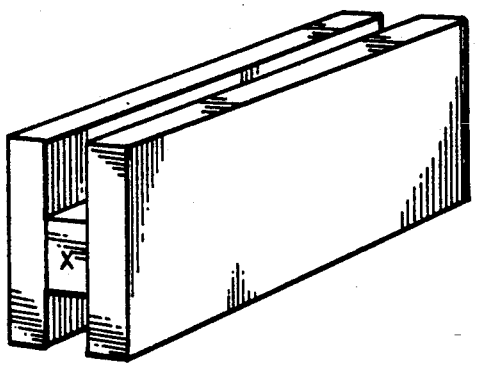
FIG. 6 shows a package of SS 1672 for testing cutting inserts in an intermittent cutting operation.

The basic toughness of the cutting inserts was tested in an intermittent cutting operation of a package of SS 1672, FIG. 6, with the following cutting data:

Cutting speed: 70 m/min

Feed: 0.2 mm/rev. (I=1.0)

Cutting depth: 1.5 mm

The value I=1.0 states that the feed is doubled in one minute from the given start value, (0.2). The test is stopped after 3 min. if no failure has occurred.

30 edges with cracks and 30 without cracks were tested against each other with the following results:

| | Relative feed at 50% failure frequency |
|---|---|
| Inserts without cracks | 1 |
| Inserts with cracks acc. to inv. | 1.33 |

In no case did failure occur in relation to or because of cracks.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A sintered cutting insert of a material comprising at least 50% by volume of at least one hard phase selected from the group consisting of carbides, nitrides, oxides and mixtures thereof of at least one metal selected from the group consisting of the group IVb, Vb and VIb elements of the periodic table, and a binder phase comprising at least one element selected from the group consisting of Co, Ni and Fe, wherein a press-body of said material is produced by nonuniformly compacting a mixture of the metal hard phase and the binder phase so that the working edges of the cutting insert after compacting the material but prior to sintering the material have a higher relative density than surrounding material and sintering the press-body.

2. The sintered cutting insert of claim 1, wherein the material is a titanium-based carbonitride alloy.

3. The sintered cutting insert of claim 2, containing surface defects on a rake face in the form of cracks having a width of 2–10 μm and a depth of up to 500 μm.

4. A method of making a cutting insert comprising the steps of:

providing a mixture of powder material comprising at least 50% by volume of at least one hard phase selected from the group consisting of carbides, nitrides, oxides and mixtures thereof of at least one metal selected from the group consisting of the group IVb, Vb and VIb elements of the periodic table, and a binder phase comprising at least one element selected from the group consisting of Co, Ni and Fe;

non-uniformly compacting the mixture to produce a pressed body having a higher relative density in areas which form the working edges in the finally sintered cutting insert; and sintering the pressed body.

5. The method of claim 4, wherein the powder material is a titanium-based carbonitride alloy.

6. The method of claim 4, wherein the pressed body is sintered at a temperature of 1300°–1500° C.

7. A sintered cutting insert of a material comprising at least 50% by volume of at least one hard phase selected from the group consisting of the carbides, nitrides, oxides and mixtures thereof of at least one metal selected from the group consisting of the group IVb, Vb, and VIb elements of the periodic table, and a binder phase comprising at least one element selected from the group consisting of Co, Ni, and Fe, wherein the cutting insert is produced by the process of:

providing a mixture of said metal hard phase and said binder phase;

non-uniformly compacting said mixture to produce a press-body having a higher relative density in the working cutting edge than in the material surrounding the cutting edge; and sintering said press-body to form a sintered cutting insert having surface defects in the form of cracks in the working cutting edge which have an inner surface consisting essentially of binder phase, said cutting insert after sintering having the same relative density throughout.

8. The sintered cutting insert of claim 7, wherein the material is a titanium-based carbonitride alloy.

9. The sintered cutting insert of claim 8, containing surface defects on a rake face in the form of cracks having a width of 2–10 μm and a depth of up to 500 μm.

10. A method of manufacturing a sintered cutting insert of a material comprising at least 50% by volume of at least one hard phase selected from the group consisting of the carbides, nitrides, oxides and mixtures thereof of at least one metal selected from the group consisting of the group IVb, Vb, and VIb elements of the periodic table, and a binder phase comprising at least one element selected from the group consisting of Co, Ni, and Fe, the process comprising the steps of:

providing a mixture of said metal hard phase and said binder phase;

non-uniformly compacting said mixture to produce a press-body having a higher relative density in the working cutting edge than in the material surrounding the cutting edge; and sintering said press-body to form a sintered cutting insert having surface defects in the form of cracks in the working cutting edge which have an inner surface consisting essentially of binder phase, said cutting insert after sintering having the same relative density throughout.

11. The method of claim 10, wherein the powder material is a titanium-based carbonitride alloy.

12. The method of claim 10, wherein the sintering step is performed at a temperature of 1300°–1500° c.

* * * * *